US007547223B2

(12) United States Patent
Liao

(10) Patent No.: US 7,547,223 B2
(45) Date of Patent: Jun. 16, 2009

(54) ELECTRICAL CONNECTOR WITH LATCHING PORTION

(75) Inventor: Fang-Chu Liao, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/284,362

(22) Filed: Sep. 22, 2008

(65) Prior Publication Data

US 2009/0081892 A1 Mar. 26, 2009

(30) Foreign Application Priority Data

Sep. 22, 2007 (CN) ..... 2007 2 0044131

(51) Int. Cl.
*H01R 12/00* (2006.01)

(52) U.S. Cl. ..... 439/330

(58) Field of Classification Search ..... 439/71, 439/72, 660, 609, 330

See application file for complete search history.

(56) References Cited

U.S. PATENT DOCUMENTS

| | | | | |
|---|---|---|---|---|
| 3,754,203 | A * | 8/1973 | Pauza et al. | 439/71 |
| 4,089,575 | A * | 5/1978 | Grabbe | 439/71 |
| 4,750,890 | A * | 6/1988 | Dube et al. | 439/152 |
| 5,288,238 | A * | 2/1994 | Ikenaka et al. | 439/91 |
| 7,281,954 | B1 * | 10/2007 | Hashiguchi | 439/660 |

* cited by examiner

*Primary Examiner*—Neil Abrams
*Assistant Examiner*—Phuong Nguyen
(74) *Attorney, Agent, or Firm*—Wei Te Chung

(57) ABSTRACT

An electrical connector, for electrically connecting an IC package to a printed circuit board, includes an insulative housing and a number of terminals received in the insulative housing. The insulative housing has a base portion and four peripheral walls extending upwardly from the base portion. The insulative housing has four corners and three of the four corners have a latching portion extending inwardly from a top end of corresponding corner, respectively, and the rest one corner is formed with an indentation. The latching portion guides and resists the IC package in the insulative housing. Thus, the latching portions of the connector are molded easily.

20 Claims, 4 Drawing Sheets

ELECTRICAL CONNECTOR WITH LATCHING PORTION

BACKGROUND OF THE INVENTION

1. Field of the Invention

The present invention relates to an electrical connector, and particularly to an electrical connector electrically connecting a semiconductor package such as an IC package to a printed circuit board.

2. Description of Related Art

As we all know, a conventional electrical connector generally comprises an insulative housing having a plurality of terminals, a stiffener surrounding the housing and formed with an engaging portion, a cover rotatablely mounted on the insulative housing and having a tongue portion, and a lever engaging with the tongue portion of the cover. When an IC package is positioned in the housing, the cover is rotated to a close position and fastens the IC package at the close position via an engagement between the lever and the engaging portion of the cover. The IC package is fixed in the housing by operating the lever and the cover. However, it is complicated to assemble the cover and the lever onto the housing. Simultaneously, it may take much more space to position the lever and the cover, so that it is difficult to apply the electrical connector in a printed circuit board without enough space. In addition, the cover and the lever have special shapes, thus a manufacture cost of the whole connector is increased.

To solve the above-mentioned problem, an improved electrical connector 1' is shown in FIG. 1 for electrically connecting an IC package 2' and a printed circuit broad 3'. The connector 1' includes an insulative housing 4' and a plurality of terminals (not shown) received in the insulative housing 4'. The insulative housing 4' is configured to a rectangular flat board and defines two deflectable latches 5' extending symmetrically and upwardly from two opposed ends of each side thereof. An accepting cavity for receiving the IC package is defined by all the latches 5' and the flat board. Each latch 5' defines an oblique leading section 51' for leading the IC package 2' to install into the accepting cavity of the connector 1'. The latches 5' latch the sides of the IC package 2' to retain the IC package 2' in the electrical connector 1'. When the IC package 2' is retained in the connector 1', the latches 5' press a top surface of the IC package 2' to prevent the IC package 2' from falling and get a reliable electrically interconnection between the IC package 2' and the connector 1'.

However, the latches 5' of the electrical connector 1' above-mentioned are usually defined above a region of the flat board of the insulative housing 4' where the terminals are received. In this case, the latches 5' of the electrical connector 1' are difficult to be molded with the insulative housing 1'.

In view of the above, it is strongly desired to provide an improved electrical connector to overcome the above-mentioned disadvantage.

SUMMARY OF THE INVENTION

Accordingly, an object of the present invention is to provide an electrical connector, which has an easily molded insulative housing.

To fulfill the above-mentioned object, an electrical connector comprises an insulative housing formed with a base portion and a plurality of peripheral walls extending upwardly and defining a receiving section between said peripheral walls for receiving the IC package thereon together with the base portion, and the insulative housing having a plurality of passageways therethrough, at least one latching portion extending from a corner formed between two adjacent peripheral walls toward the receiving section and resisting against an upper surface of the IC package for retaining the IC package into the insulative housing; and a plurality of terminals disposed in the corresponding passageways, respectively.

Other objects, advantages and novel features of the present invention will become more apparent from the following detailed description when taken in conjunction with the accompanying drawings, in which:

DESCRIPTION OF PREFERRED EMBODIMENT

Reference will now be made to the drawings to describe the present invention in detail.

Figure 1:
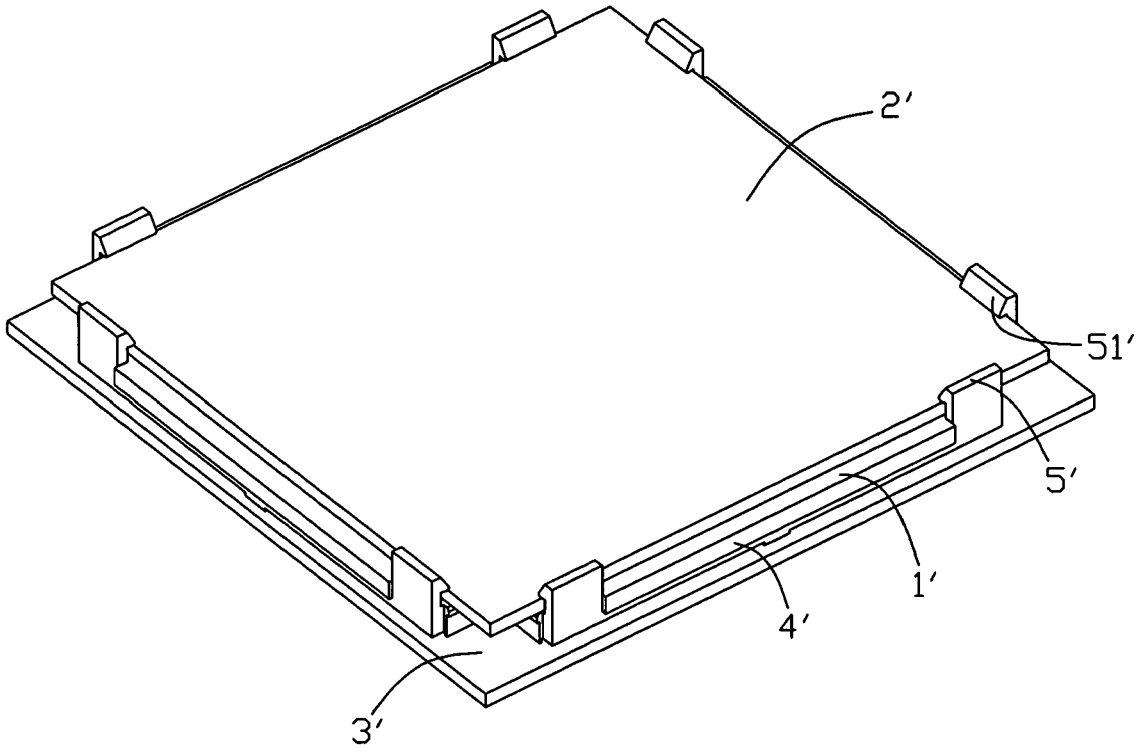
FIG. 1 (PRIOR ART)
FIG. 1 is a perspective view of a conventional electrical connector assembled with an IC package.
Figure 2:
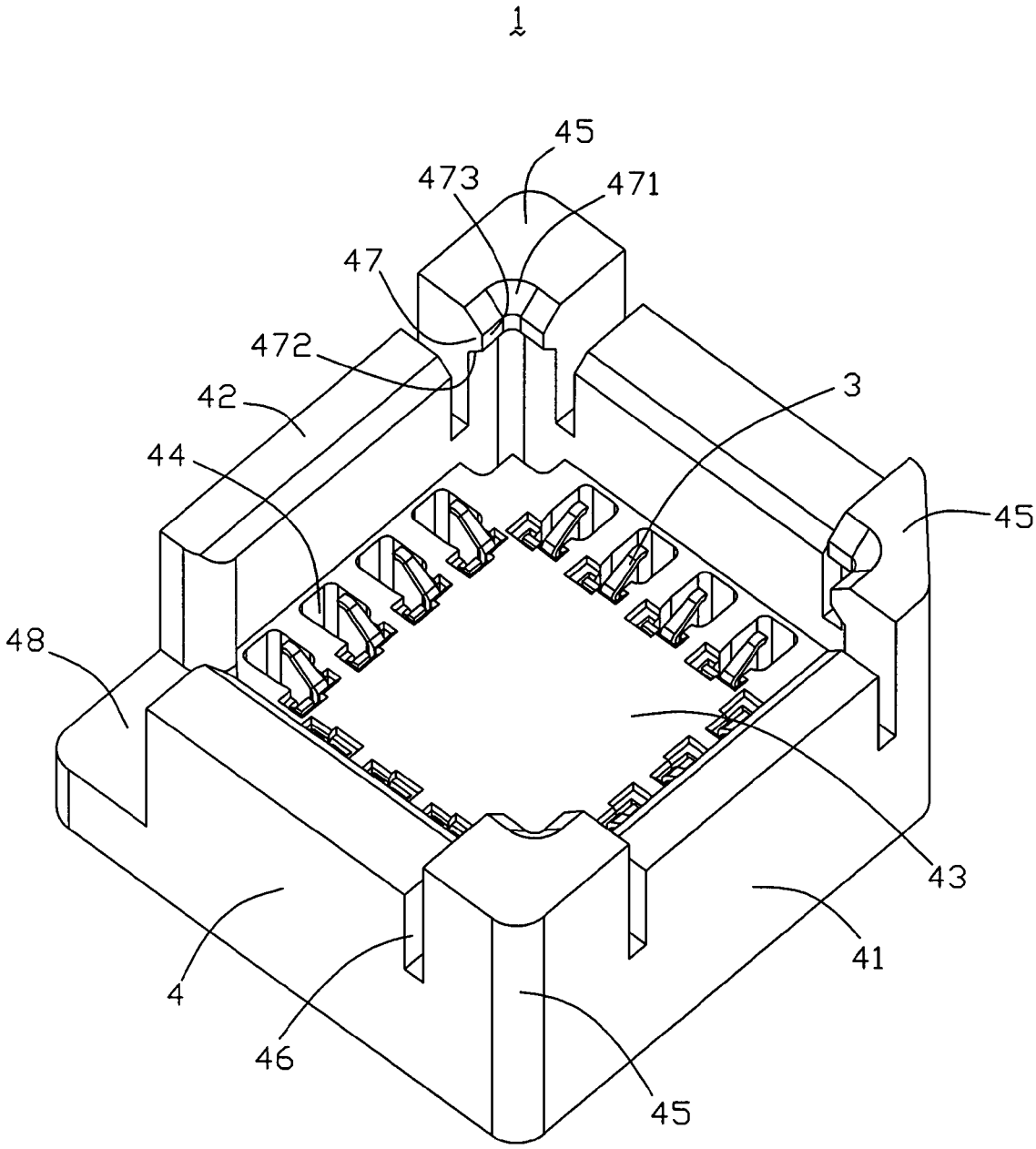
FIG. 2 is a perspective view of an electrical connector in accordance with an embodiment of the present invention.
Figure 3:
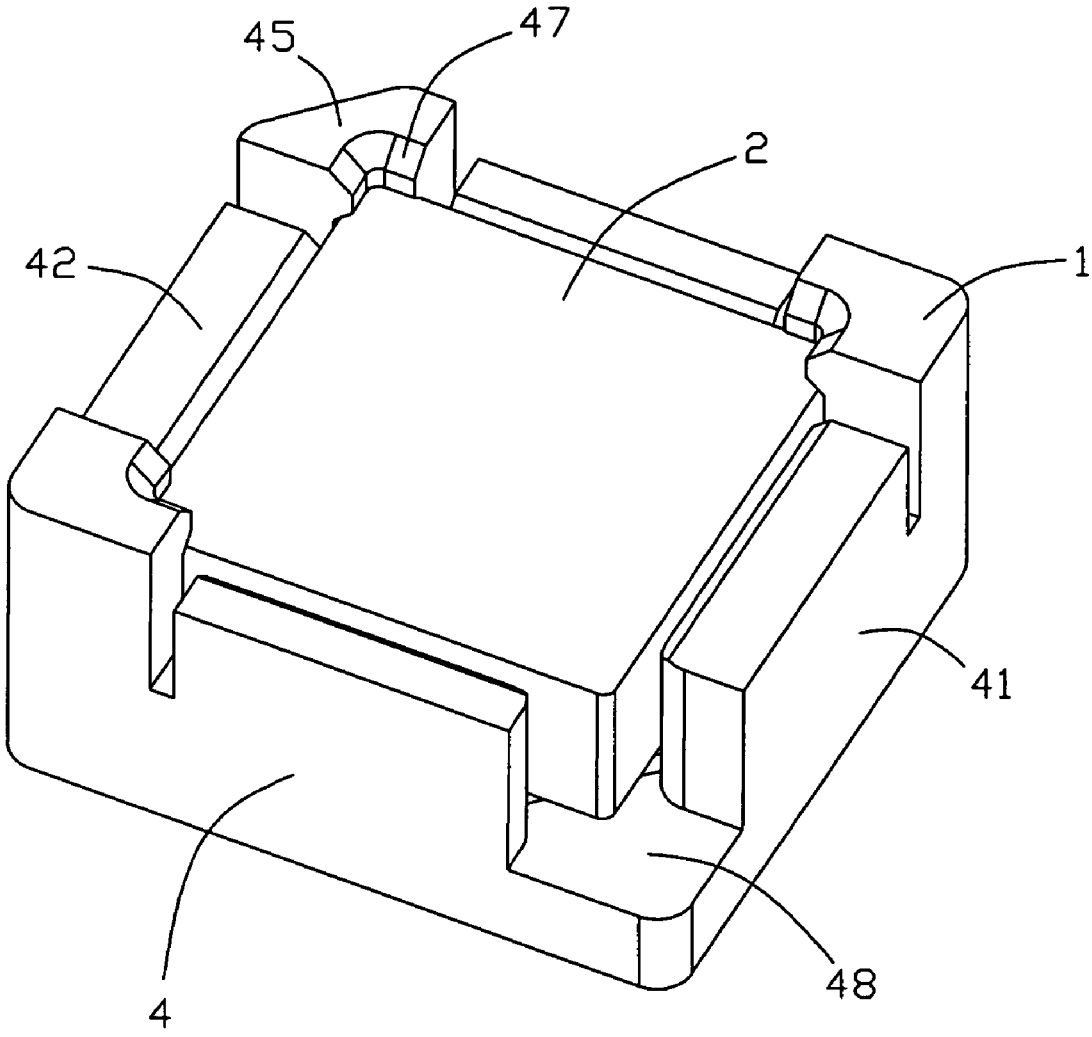
FIG. 3 is a perspective view of the electrical connector in FIG. 2 assembled with an IC package.

Referring FIGS. 2-3, an electrical connector 1 in accordance with an embodiment of the present invention, for electrically interconnecting an IC package 2 to a printed circuit board (not shown), comprises an insulative housing 4 and a plurality of terminals 3 received in the insulative housing 4.

The insulative housing 4 is generally configured to a rectangular shape and includes a base portion 41 and four surrounding peripheral walls 42 upwardly and vertically extending from the base portion 41. The base portion 41 and the walls 42 define a receiving area 43 together. A plurality of passageways 44 for receiving the terminals 3 are defined in rows on the receiving area 43 and pass throughout the receiving area 43 except corners of the receiving area 43.

Four corners are formed between every two adjacent walls 42, wherein three of the corners are formed with a projecting corner 45 and a groove 46 is defined between the corner 45 and an adjacent wall 42 and extends downwardly from a top surface of the corner 45. Each corner 45 is formed with a V-shaped latching portion 47 extending inwardly from a top end of the corner 45. The latching portion 47 includes a top leading surface 471, a bottom mating surface 472 approximately symmetrical to the leading surface 471 and a vertical transitional surface 473 connecting the leading surface 471 and the mating surface 472. Additionally, the rest one corner is formed with an indentation 48 for removing the IC package 2 in the receiving area 43, and the indentation 48 is lower than the receiving area 43.

Figure 4:
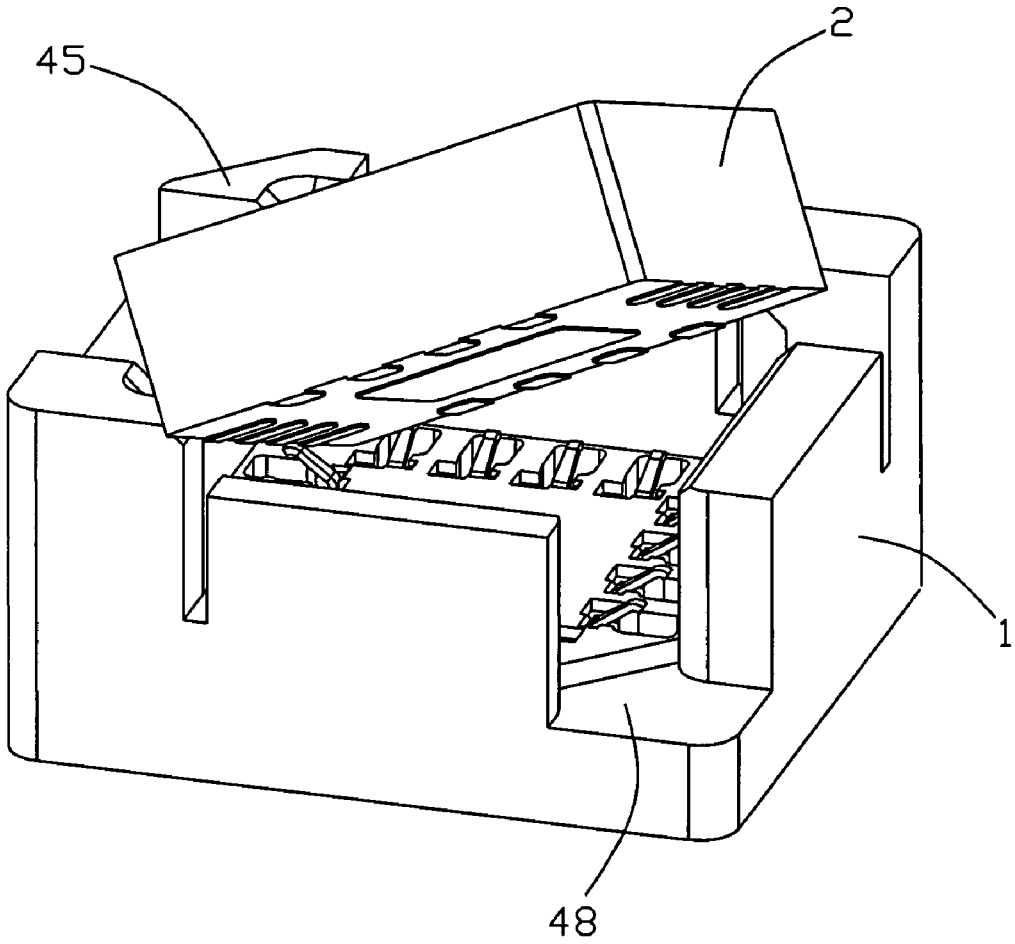
FIG. 4 is a perspective view of the electrical connector in FIG. 3 showing the IC package being lifted.

Turning now to FIGS. 3 and 4, the IC package 2 is located steadily in the insulative housing 4 of the connector 1, and the terminals 3 engages pads (not shown) of the IC package 2. When the IC package 2 is loaded in the connector 1, the IC package 2 is firstly leaded by the leading surface 471 of the latching portion 47, and secondly glides through the transitional surface 473, and finally is retained in the connector 1 by engaging with the mating surface 472. At last, all the latching portions 47 resist against an upper surface of the IC package 2 for retaining the IC package 2 in the insulative housing 4. As shown in FIG. 4, to pick up the IC package 2, the indentation 48 offers enough space for fingers of an operator to lift the IC package 2 up.

As mentioned above, the electrical connector 1 defines three latching portions 47 extending form three corners 45 of the insulative housing 4, and the indentation 48 disposed on the rest one corner of the insulative housing 4. Compared to the electrical connector 1' disclosed in the related art, the latching portions 47 are located near the corners 45 of the insulative housing 4 where no passageway 44 is defined. Accordingly, the latching portions 45 of the insulative housing 4 are molded easily and have better intensity. It is noted that in the preferred embodiment the latching portion 45 provides restriction for both vertical and lateral directions.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector adapted for electrically connecting an IC package to a printed circuit board, comprising:

an insulative housing formed with a base portion and a plurality of peripheral walls extending upwardly and vertically extending from the base portion defining a receiving section between said peripheral walls for receiving the IC package thereon, and the insulative housing having a plurality of passageways for receiving terminals therethrough, at least one V-shaped latching portion extending from a corner formed between two adjacent peripheral walls toward the receiving section and resisting against an upper surface of the IC package for retaining the IC package into the insulative housing, where no passages is defined; and a plurality of terminals disposed in the corresponding passageways, respectively;

three V-shaped latching portions extending from three corners of the insulative housing to provide the restriction on both vertical and lateral directions; the latching portions of the insulative housing are molded and have better intensity and a rest one corner of the insulative housing is formed with an indentation for removing the package in the receiving area, and each of the V-shape latching portion has a top leading surface for leading the IC package, a bottom mating surface approximately symmetrical to the leading surface and a transitional surface connecting the leading surface and the mating surface;

a space is formed on the peripheral wall for increasing resiliency on the housing;

the insulative housing has four peripheral walls which is defined at the four corners between each two adjacent peripheral walls.

2. The electrical connector as claimed in claim 1, wherein the space comprising a groove, the groove is defined between the corner and an adjacent peripheral wall.

3. The electrical connector as claimed in claim 1, wherein said passageways neighbor the corresponding peripheral walls while relatively spaced from the corner.

4. The electrical connector as claimed in claim 1, wherein one of corner of the housing diagonally opposite to another corner is provided with another latching portion to cooperate with said latching portion for latching the IC package in said receiving section.

5. The electrical connector as claimed in claim 1, wherein said two peripheral walls are provided without any locking structures thereon for locking the IC package.

6. The electrical connector as claimed in claim 5, wherein the two diagonally located corners of the housing respectively beside said two peripheral walls, are respectively provided with the latching portions.

7. The electrical connector as claimed in claim 1, wherein the indentation offers enough space for fingers of an operator to lift the IC package up.

8. The electrical connector as claimed in claim 7, wherein; said-top leading surfaces are acting as guiding surfaces.

9. The electrical connector as claimed in claim 8, wherein the indentation is lower than the receiving area.

10. An electrical connector adapted for electrically connecting an IC package to a printed circuit board, comprising:

an insulative housing having a receiving section for receiving the IC package, a plurality of through passageways, and a plurality of corners extending substantially upwardly, at least one corner having a latching portion extending inwardly toward the receiving section and away from a top end thereof for guiding and resisting against the IC package; and the latch portion extending from the corner formed between two adjacent peripheral walls toward the receiving section and resisting against an upper surface of the IC package for retaining the IC package into the insulative housing, where no passages is defined; and a plurality of terminals received in the corresponding passageways;

three latching portions extending from three corners of the insulative housing to provide the restriction on both vertical and lateral directions; the latching portions of the insulative housing are molded and have better intensity and a rest one corner of the insulative housing is formed with an indentation for removing the package in the receiving area, and each of the latching portion has a top leading surface for leading the IC package, a bottom mating surface approximately symmetrical to the leading surface and a transitional surface connecting the leading surface and the mating surface, a space is formed on the peripheral wall for increasing resiliency on the housing;

the insulative housing has four peripheral walls which is defined at the four corners between each two adjacent peripheral walls.

11. The electrical connector as claimed in claim 10, wherein said each latching portion has a "V" shape.

12. The electrical connector as claimed in claim 10, wherein the indentation is lower than the receiving area.

13. A method of assembling an IC package into an electrical connector, comprising the steps of:

providing an insulative housing with a base with an upward facing receiving space thereabove;

disposing a plurality of terminals in the base with contacting sections upwardly extending into the receiving space;

providing a plurality of V-shaped latching portions on a plurality of specific corners of said housing; and installing said IC package into the receiving cavity by guiding on a top lead surface of the plurality of latching portions under a condition of initially lowering a corner region of said IC package downward to be located under said latching portions with the IC package being in a tilted manner, and rotating successively said IC package to a horizontal manner within the receiving cavity; wherein an upward force generated by the contacting sections urges the IC package upwardly so as to have said corner region of the IC package abut upwardly against the latching portion;

providing an indentation at one of the corner of the insulation portion, where no latching portion is located and with a height being lower than a height of the plurality of latching portions;

providing a space on the peripheral walls for increasing resiliency on the housing when the IC package being inserted;

removing the IC package from the receiving area by mean of the indentation.

14. The method of assembling an IC package into an electrical connector as claimed in claim 13, wherein said housing further includes a plurality of peripheral walls for cooperating with said base to form said receiving space, and said specific corner is located between two adjacent peripheral walls of said peripheral walls.

15. The method of assembly an IC package into an electrical connector as claimed in claim 14, further providing a step of providing another two latching portions at two diagonal corners of said housing which are neighboring to said specific corner.

16. The method of assembly an IC package into an electrical connector as claimed in claim 14, wherein said latching portion is spaced from each corresponding neighboring peripheral wall with a groove for increasing resiliency thereof.

17. The method of assembling an IC package into an electrical connector as claimed in claim 14 further providing a step of providing another latching portion at least one of other corners of said housing.

18. The method of assembly an IC package into an electrical connector as claimed in claim 17, wherein said another latching portion is provided on the corner neighboring said specific corner rather than being diagonal thereto.

19. The method of assembly an IC package into an electrical connector as claimed in claim 17, wherein said another latching portion is provided on the corner diagonal to said specific corner rather than neighboring thereto.

20. The method of assembly an IC package into an electrical connector as claimed in claim 17, wherein said another latching portion is spaced from each corresponding neighboring peripheral wall with a groove for increasing resiliency thereof.

* * * * *